US005911095A

United States Patent [19]

Atsumi et al.

[11] Patent Number: 5,911,095

[45] Date of Patent: Jun. 8, 1999

[54] IMAGE FORMING APPARATUS MANAGEMENT SYSTEM WHICH MANAGES NUMBER OF IMAGE FORMATIONS PERFORMED BY AN IMAGE FORMING APPARATUS ON A USER BASIS

[75] Inventors: Tomoyuki Atsumi, Toyohashi; Tomokazu Kato; Hidenobu Nakamura, both of Toyokawa; Hiroyuki Asai, Okazaki, all of Japan

[73] Assignee: Minolta Co., Ltd., Osaka, Japan

[21] Appl. No.: 08/962,663

[22] Filed: Nov. 3, 1997

[30] Foreign Application Priority Data

Nov. 7, 1996 [JP] Japan ..... 8-295141

[51] Int. Cl.[6] ..... G03G 15/00

[52] U.S. Cl. ..... 399/80; 399/8

[58] Field of Search ..... 399/80, 79, 75, 399/10, 8; 364/131, 138, 139

[56] References Cited

U.S. PATENT DOCUMENTS

| | | | |
|---|---|---|---|
| 4,583,834 | 4/1986 | Seko et al. | 399/8 X |
| 5,077,582 | 12/1991 | Kravette et al. | 399/8 |
| 5,282,127 | 1/1994 | Mii | 399/8 X |
| 5,347,346 | 9/1994 | Shimizu et al. | 399/8 |
| 5,412,779 | 5/1995 | Motoyama | 399/8 |
| 5,631,724 | 5/1997 | Sawada et al. | 399/8 X |
| 5,673,190 | 9/1997 | Kahleck et al. | 399/8 |

*Primary Examiner*—Arthur T. Grimley
*Assistant Examiner*—Hoan Tran
*Attorney, Agent, or Firm*—Burns, Doane, Swecker & Mathis, L.L.P.

[57] ABSTRACT

A host computer is connected to a copying machine through communication lines. The copying machine includes an management apparatus which is provided with a card reader. Using the card reader, a section code stored in a user ID card is read and is compared with section codes previously registered in the management apparatus. When the section code of the user ID card matches one of the section codes registered in advance, copying operation is allowed and the section code and the number of copying operations are stored as management data in a registration table stored in an SRAM. When the amount of available storage space becomes less than the predetermined amount, the management apparatus transmits the registered management data to the host computer through the communication lines, clears the storage area and waits for next registrations. The host computer has an accumulating table which is capable of storing the numbers of copying operations for all the sections subjected to management. The host computer receives the management data and updates the number of copying operations of the corresponding section.

27 Claims, 14 Drawing Sheets

FIG. 4

REGISTRATION TABLE T

| AREA NO | SECTION CODE | NUMBER OF COPYING OPERATIONS |
|---|---|---|
| 01 | 25 | 28 |
| 02 | 15 | 120 |
| ⋮ | ⋮ | ⋮ |
| 16 | 09 | 25 |
| 17 | 00 | 0 |
| 18 | 00 | 0 |
| 19 | 00 | 0 |
| 20 | 00 | 0 |

IMAGE FORMING APPARATUS MANAGEMENT SYSTEM WHICH MANAGES NUMBER OF IMAGE FORMATIONS PERFORMED BY AN IMAGE FORMING APPARATUS ON A USER BASIS

BACKGROUND OF THE INVENTION (1) Field of the Invention

The present invention relates to an image forming apparatus management system which manages the number of image formations performed by an image forming apparatus, such as a copying machine, on a user basis using a central accumulating apparatus.

(2) Related Art

Organizations such as companies may own a number of copying machines. A bill corresponding to the number of copying operations is issued regularly, for example, at the end of every month, to each section. To prepare this bill, the number of copying operations has to be accumulated for each section and for each copying machine. If this accumulating work is done by hand for each copying machine, it consumes a lot of time and effort. In recent years, there have been many cases where a system which manages the number of copying operations for each section with copying machines being connected respectively to a host computer through lines is used (hereafter, this system is referred to a "copying machine management system") to improve the efficiency of the accumulating work.

When using such a copying machine management system, a card magnetically recording an identification number of a section (such card is referred to as an "ID card" hereafter) is given to each section and each copying machine is provided with a management apparatus including a card reader which reads the identification number of the ID card. The card reader reads the identification number recorded on the ID card and compares it with identification numbers previously stored in the internal memory to determine if there is a match. Copying operations are only allowed when there is a match.

A memory which cumulatively stores the number of copying operations for each section is provided (the memory is referred to as the "management memory" hereafter) in the management apparatus. The management memory stores the number of copying operations for a section, which is allowed to use the copying machine, into the management memory area which corresponds to the section. The stored contents in the management memory are transmitted from the management apparatus to the central host computer regularly, for example, at the end of every month, through communication lines. The host computer receives the data, accumulates the number of copying operations for each section and generates the bills in accordance with instructions from an operator.

Using the copying machine management system, the number of copying operations stored in all the copying machines for each section are accumulated automatically. As a result, it contributes largely to the rationalization of clerical work.

In a large company, however, the number of sections using copying machines may exceed more than 100 sections. Except for copying machines installed in rooms such as conference rooms for common use, a copying machine of one section is not often used by the users belonging to other sections. Nevertheless, if the management memory of the management apparatus of each copying machine provides a memory area for storing the number of copying operations of all the sections as before, most of the memory capacity will go to waste, which is highly uneconomical.

Meanwhile, if a small amount of memory is used and the number of sections that can be handled by each copying machine is reduced, a user of one section may not be able to use the copying machines of other sections with the user's ID card. The user will then have to go back to his/her own section to make a copy, which is inconvenient and inefficient for clerical work.

SUMMARY OF THE INVENTION

In view of the stated problems, it is a general object of the present invention to provide an image forming apparatus management system which enables a user to use image forming apparatuses of all sections subjected to the management using a small amount of management memory in each image forming apparatus, and which can reliably manage an image forming operation performed by each image forming apparatus.

This object can be achieved by an image forming apparatus management system, the image forming apparatus management system including: a image forming apparatus and a central accumulating apparatus which is connected to the image forming apparatus through lines, wherein the image forming apparatus is made up of: an identification code reception unit for receiving at least one identification code that identifies a user; a counting unit for counting a number of image formations for each identification code; a first storage unit for storing each identification code received by the identification code reception unit associated with the number of image formations counted by the counting unit; a transmission unit for transmitting all identification codes and associated numbers of image formations stored in the first storage unit to the central accumulating apparatus via the communication line when a number of identification codes in the first storage unit reaches a predetermined number; and a storage clearing unit for clearing the first storage unit after all the identification codes and associated numbers of image formations have been transmitted by the transmission unit, and wherein the central accumulating apparatus is made up of: a reception unit for receiving the identification codes and associated numbers of image formations transmitted from the image forming apparatus; and an accumulating unit for accumulating and storing data of the number of image formations for each user in accordance with the identification codes and associated numbers of image formations received by the reception unit.

This object can be also achieved by an management method for a number of image formations in an image forming apparatus management system which is made up of a central accumulating apparatus and an image forming apparatus, wherein the management method includes first step performed by the image forming apparatus and second step performed by the central accumulating apparatus, wherein the first step includes: a step of receiving at least one identification code for identifying a user and of counting the number of image formations performed in relation to the received identification code; a step of storing a received identification code associated with the number of image formations performed in relation to each identification code into a first storage unit; a step of transmitting each identification code and associated number of image formations stored in the first storage unit through lines when a number of identification codes stored in the first storage unit reaches a predetermined number; and a step of clearing all identification codes and the numbers of image formations stored in the first storage unit after transmission by the transmission unit, and wherein the second step includes: a step of receiving the identification codes and associated number of image formations which are transmitted from the image forming apparatus; and a step of accumulating and storing data of the number of image formations for each user in accordance with the identification codes and associated number of image formations received by the reception unit.

By means of the stated construction, the first storage unit of the image forming apparatus only has to store the predetermined number of identification codes and associated numbers of image formations so that only a small amount of memory is needed. Meanwhile, the central accumulating apparatus receives data including an section code and a number of image formations from the image forming apparatus and accumulates the number of image formations in accordance with the received data, so that the number of image formations can be managed for each user identification code.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 4 shows an example of a registration table in an SRAM of the management control unit;

DESCRIPTION OF PREFERRED EMBODIMENT

The following is an explanation of an embodiment of the present invention, taking a copying machine management system as one example.

(1) Structure of Copying Machine Management System

Figure 1:
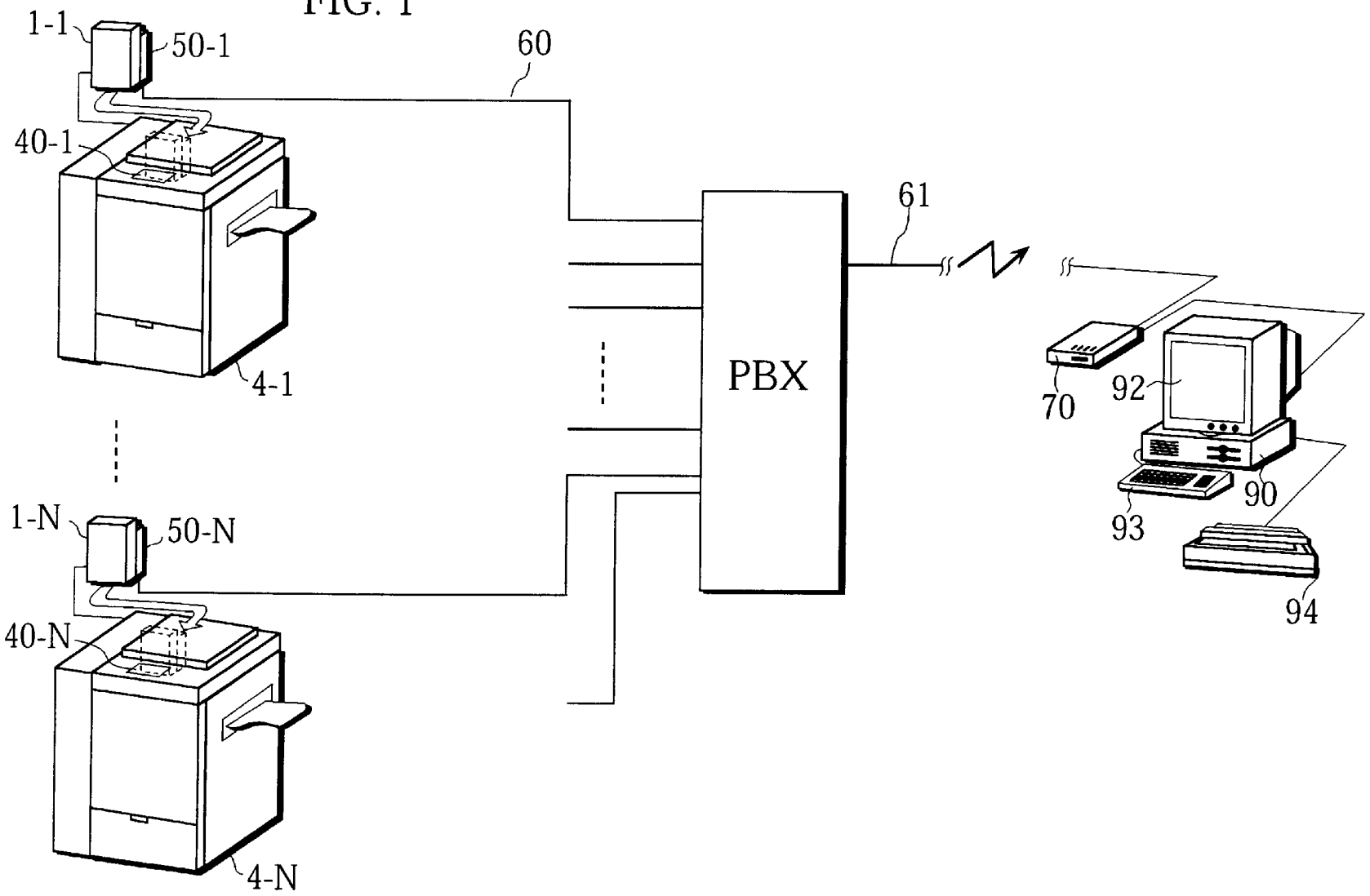
FIG. 1 shows the overall structure of a copying machine management system of an embodiment of the present invention.

FIG. 1 shows the overall structure of the copying machine management system of the embodiment of the present invention. In the management system shown in FIG. 1, the N copying machines 4-1, 4-2, . . . 4-N which are subjected to management are connected via analog local telephone lines 60 to a private branch exchange (PBX) that is in turn connected via a public telephone line 61 to a host computer 90 of a remote service center. In the following description, the notation "copying machine 4" refers to any out of the N copying machines, with this also being the case for the management apparatus 1 and the user communication terminal 50 provided in each copying machine.

The copying machine 4 is a conventional electrophotographic copying machine which forms a toner image on a photosensitive drum in accordance with the document information read by a scanner and transfers it onto a copying sheet. An operation panel 40 is provided on the optimum position of the top of the copying machine 4. The management apparatus 1 is provided at the side of the copying machine 4 and manages the number of copying operations performed by the copying machine 4 for each section which uses the copying machine 4. A user communication terminal 50 for transmitting the management data from the management apparatus 1 to the host computer 90 through the PBX using the analog local telephone line 60 and the external public telephone line 61 (these lines and the PBX are generically referred to as "communication lines" hereafter) is also provided.

The management apparatus 1 includes a card reader (not illustrated) which has a magnetic head inside. When an ID card magnetically storing the information of a section identification number (referred to as a "section code" hereafter) is inserted, the management apparatus 1 reads the information using the magnetic head to determine whether to allow the copying operation. If the copying operation is allowed, the number of copying operations is stored together with the section code in a registration table T (see FIG. 4) provided within the management apparatus 1. When the stored number of sections exceeds the predetermined number, as described later, the information of the registration table T, i.e., the data of the section codes and the numbers of copying operations (referred to as "management data" hereafter), is transmitted to the host computer 90 through the communication lines. At the same time, the present storage area where the transmitted management data had been stored in the registration table T is cleared and is ready to be overwritten. It should be noted here that the numbers from "01" to "99" are set as the section codes according to this embodiment, so that 99 sections or less can use the management system.

Meanwhile, the host computer 90 is composed of a CPU as a main component, and a service center communication terminal 70 for performing data communication with the management apparatus 1 of the copying machine 4 through the communication lines, a display 92 for display, a keyboard 93 and a printer 94 for printing documents such as bills are provided as the peripheral devices. The host computer 90 controls these components to manage the number of copying operations for all the sections which are subjected to management.

A RAM 97 (see FIG. 3) for accumulation provided within the host computer 90 has a storage area to store the number of copying operations corresponding to each section code. The RAM 97 adds the number of copying operations included in the management data which were received from the management apparatus 1 to the number of copying operations already stored in the corresponding area for the section, and stores the result as the updated number. Periodically, such as at the end of every month, the amount billed to each section is calculated based on the stored content of the RAM 97 in accordance with a predetermined operation made by the user via the keyboard 93. The calculated result is then outputted by the printer. Accordingly, the bills for copying operations are sent to the sections from the service center.

(2) Structures of Control Units of Apparatuses

Figure 2:
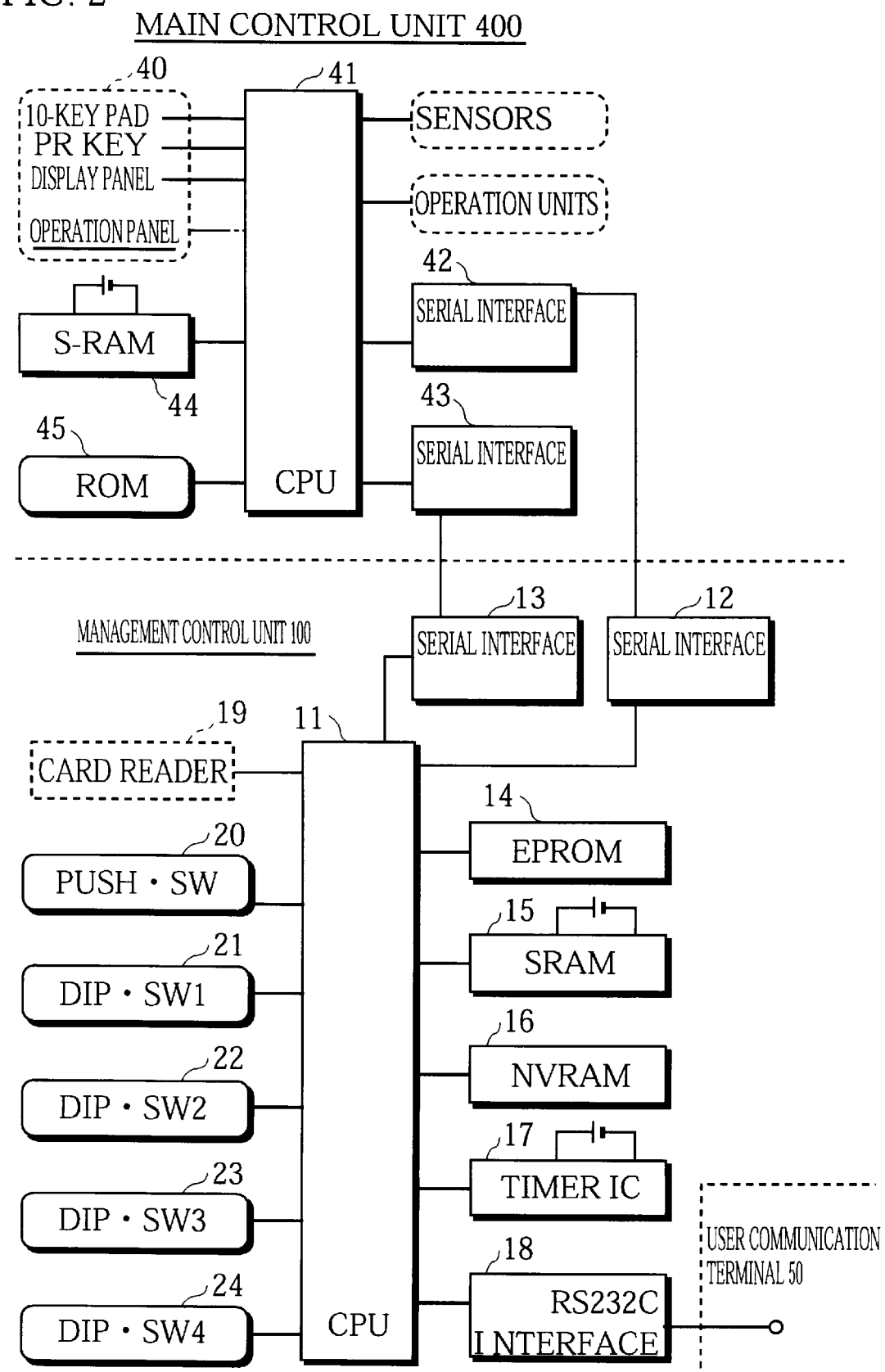
FIG. 2 is a block diagram showing structures of a main control unit of the copying machine and a management control unit of a management apparatus.
Figure 3:
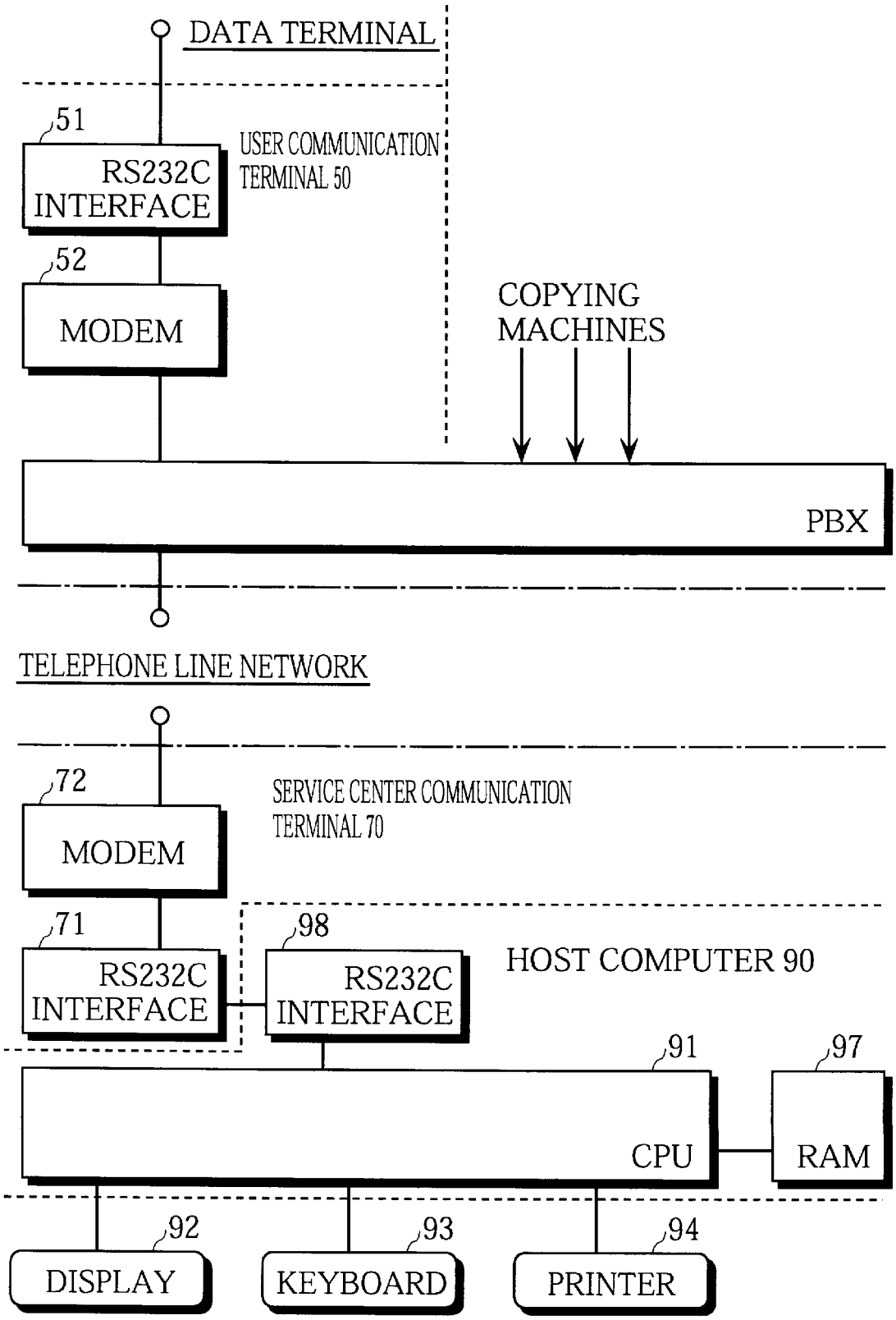
FIG. 3 is a block diagram showing structures of a user communication terminal, a service center communication terminal and a host computer.

The following explanation is about the structures of the control units of the apparatuses, with reference to the block diagrams in FIGS. 2 and 3.

FIG. 2 is a block diagram showing the structures of a main control unit 400 which controls copying operations performed by the copying machine 4 and a management control unit 100 which is provided within the management apparatus 1 and manages the number of copying operations performed by the copying machine 4.

The main control unit 400 is comprised of a CPU 41 as the main component, serial interfaces 42 and 43 for communicating with the management control unit 100, a battery-backed SRAM 44, and a ROM 45 storing the control programs for copying operations.

Detection signals of sensors, such as sensors for detecting a paper jam and the size of an original document, are inputted into the CPU 41, which indicates a necessary display on the display unit of the operation panel 40 in accordance with the detection signals. At the same time, the CPU 41 generates the control signals for the operating units, such as a scanner motor for moving the scanner and a main motor for rotating the photosensitive drum, with the appropriate timing, and to synchronizes these operating units and so perform a smooth copying operation.

The operation panel 40 is provided with a 10-key pad to set the number of copies to be made in multiple copying operations and to set the magnification ratio, a print key (PR key) for starting copying, a display unit for indicating the set number of copies to be made and the current status of the copying machine (like warm-up and a paper jam). In addition, switch keys, such as a reset key for resetting the status of the operation panel 40 and a clear key for clearing the setting of the number of copies to be made, are provided. Only after receiving the allowance signal for copying operation from the management control unit 100 via the serial interface 43, the CPU 41 receives operations from the operation panel 40 to set the copy mode and reads the corresponding control programs from the ROM 45. Then, the CPU 41 synchronizes the various units to perform the copying operation. In doing so, the CPU 41 transmits a signal indicating the completion of copying (referred to as the "copying signal" hereafter) to the management control unit 100 via the serial interface 42 each time a copying operation is performed. On receiving this copying signal, the management control unit 100 counts up the number of copying operations with relation to the present section code.

Meanwhile, the management control unit 100 is composed of: a CPU 11 as the main component; serial interfaces 12 and 13 for data communication with the main control unit 400; an EPROM 14 for storing necessary control programs; a battery-backed SRAM 15 for storing the management data as well as flags and variables for control (described later); a nonvolatile memory 16 (referred to as "the NVRAM 16" hereafter) for storing information including the identification number of the copying machine 4 (referred to as the "apparatus ID" hereafter), the section codes managed by the host computer 90 and the dial-up number of the host computer 90; a timer IC 17 for measuring the time so that the management data stored in the SRAM 15 is regularly transmitted to the host computer 90; an RS232C interface 18 for communicating with the host computer 90 via the user communication terminal 50; and a push button 20 and DIP switches 21 to 24 for registering the apparatus ID of the management apparatus 1.

The setting of the apparatus ID is made by setting an appropriate value using the DIP switches 21 to 24. After this, the push button 20 is set to "ON" and the apparatus ID is then registered in the NVRAM 16.

The CPU 11 is connected to a card reader 19 which magnetically reads the information of the ID card. When the user inserts an ID card into the card reader 19, the information of the section code is read and is transmitted to the CPU 11.

The CPU 11 compares the section code with the previously registered section codes to determine if there is a match, and if so, the CPU 11 transmits the copying allowance signal to the main control unit 400 through the serial interface 13. On receiving this copying allowance signal for copying operation via the serial interface 43, the CPU 41 of the main control unit 400 receives operations from the user via the operation panel 40, performs the copying operation in accordance with the indicated copy mode, and transmits the copying signal to the management apparatus 1 through the serial interface 42.

On receiving this copying signal through the serial interface 12, the CPU 11 of the management apparatus 1 counts up the number of copying operations with relation to the received section code. The number of copying operations obtained here is stored, as the management data, in the registration table T set inside the SRAM 15.

An example of the structure of the registration table T is shown in FIG. 4. As shown in FIG. 4, the management data, i.e., pairs of a section code and a number of copying operations, are registered in the storage areas comprising the area numbers 1 to 20 vertically in order.

When meeting certain conditions described later, each management data registered in the registration table T is transmitted together with the apparatus ID data to the host computer 90 through the RS232C interface 18 and the user communication terminal 50.

FIG. 3 is a block diagram showing structures of the user communication terminal 50, the service center communication terminal 70 and the host computer 90.

The user communication terminal 50 is composed of an RS232C interface 51 and a modem apparatus 52. The management data and the apparatus ID data transmitted from the management apparatus 1 is outputted through the RS232C interface 51 to the modem apparatus 52 where this data is modulated into the analog signals and are transmitted to the host computer 90 through the communication lines and the service center communication terminal 70.

The service center communication terminal 70 is composed of a modem apparatus 72 and an RS232C interface 71. The modem apparatus 72 demodulates the management data and the apparatus ID data received through the communication lines into the digital signals and transmits the data through the RS232C interface 71 to the host computer 90.

The host computer 90 is provided with a CPU 91 as the main component, a RAM 97 and an RS232C interface 98, and receives the management data and the apparatus ID data through the RS232C interface 98.

The RAM 97 stores the apparatus IDs of the copying machines subjected to the management of the host computer 90 (referred to as the "managed apparatus ID" hereafter) and an accumulating table for the management data. As described later, the CPU 91 only receives the management data transmitted from the copying machine 4 which has an apparatus ID which matches one of the managed apparatus ID, and accumulates the number of copying operations.

It should be noted here that the accumulating table of the RAM 97 has the same structure as that of the registration table T shown in FIG. 4, except that the accumulating table of the RAM 97 is capable of storing the section codes and the number of copying operations of all the sections subjected to the management by the CPU 91 (up to 99 sections in this embodiment).

(3) Management Operation of Copying Machine Management System

The following is an explanation of the management operations of every unit in the copying machine management system, with reference to flow charts.

(3-1) Management Operation in Management Control Unit 100

Figure 5:
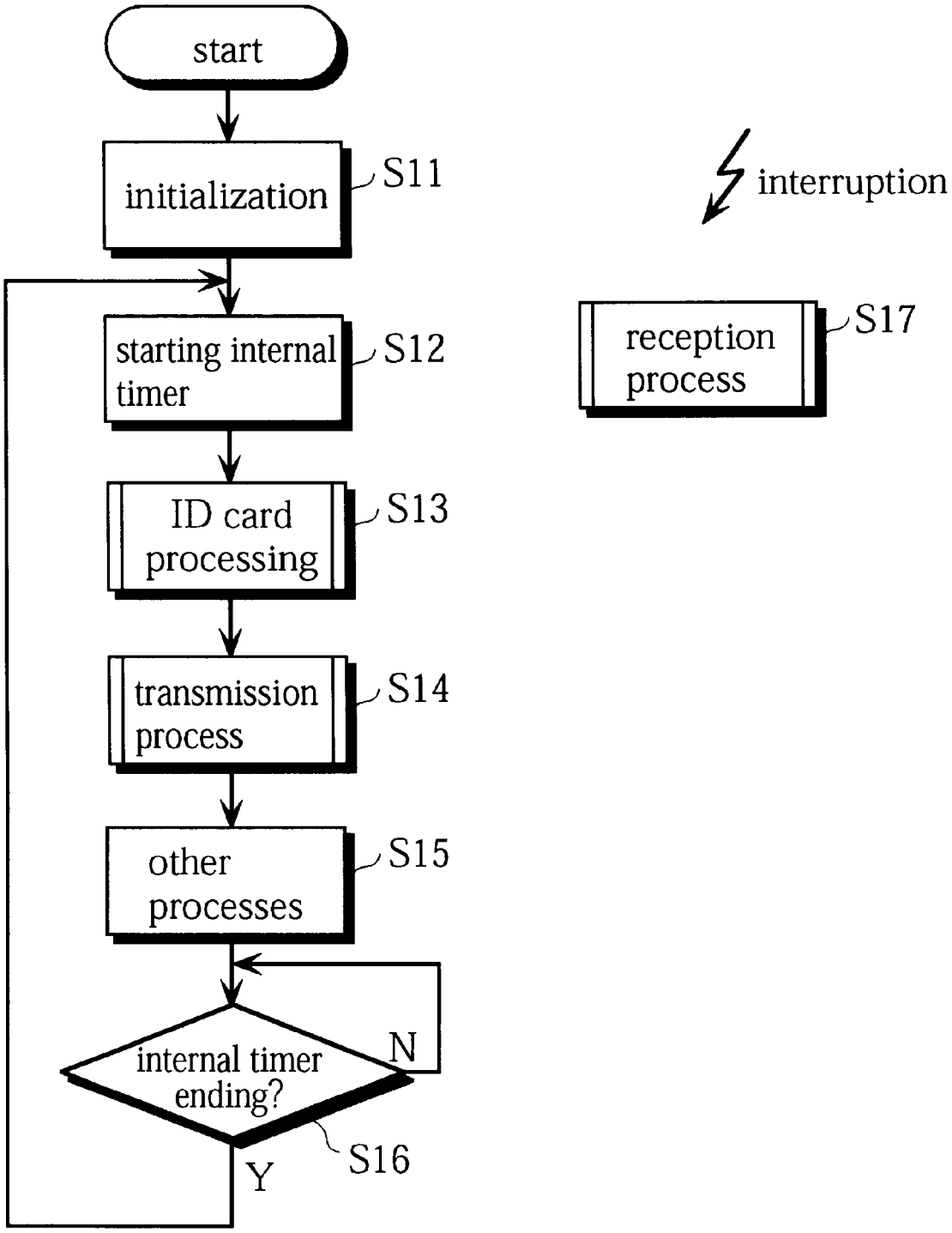
FIG. 5 is a flow chart of a main routine of the management control unit.

FIG. 5 is a flow chart of the main routine performed by the management control unit 100 of the management apparatus 1.

When the power of the copying machine 4 is turned on, the CPU 11 (see FIG. 2) reads the initialization program stored in the EPROM 14 to initialize the internal registers (step S11), and starts timing using the internal timer to monitor that the processing subroutine is performed in the specified period (steps S12 and S16).

After starting the timer, the CPU 11 performs the ID card processing (step S13) and determines whether to allow copying operation in accordance with the status of the ID card insertion in the card reader 19 and the section code read from the ID card.

Figure 6:
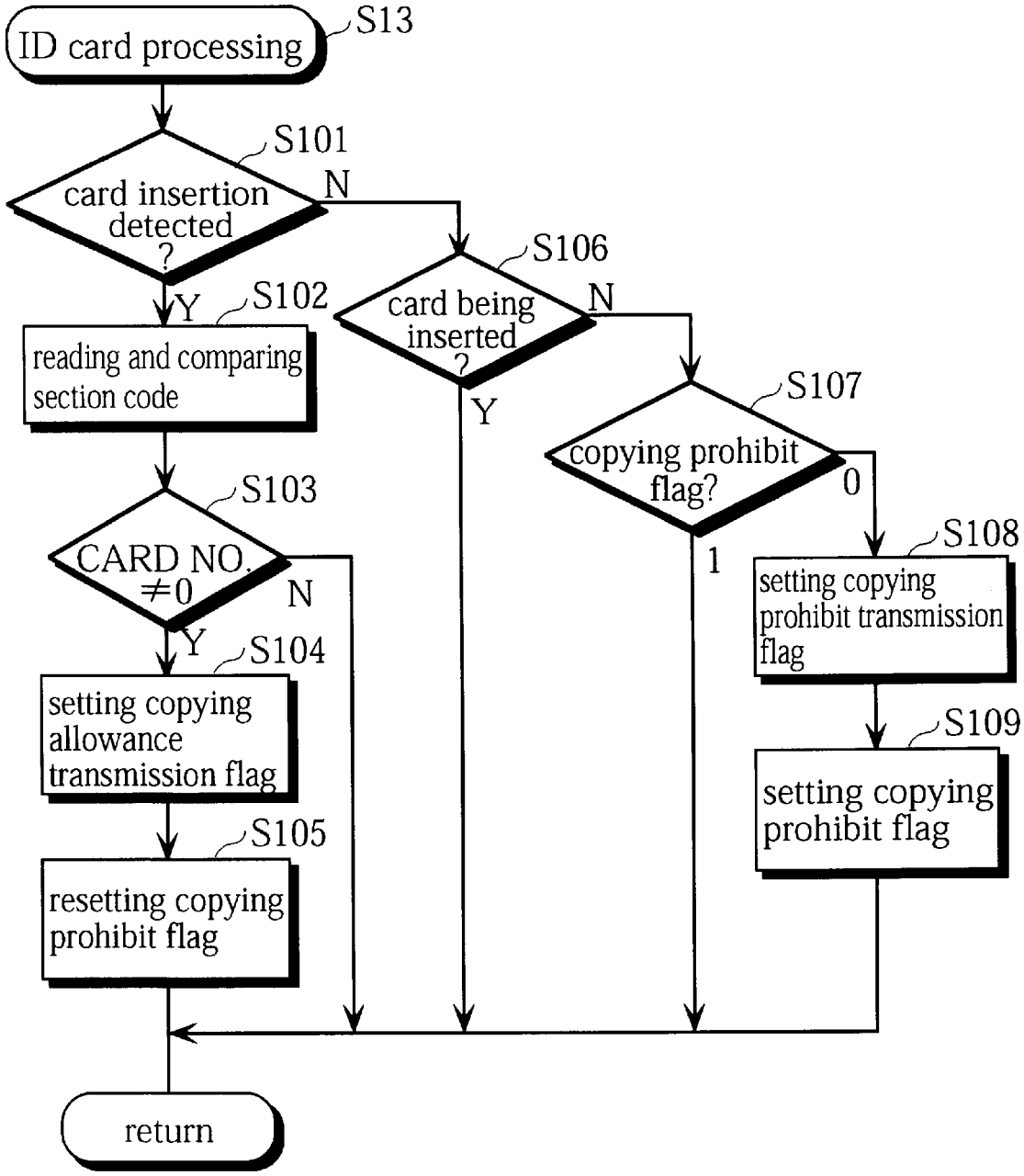
FIG. 6 is a flow chart of a subroutine of the ID card processing (step S13) in FIG. 5.

FIG. 6 is a flow chart showing a subroutine of the ID card processing in step S13.

The CPU 11 detects whether an ID card has been inserted into the card reader 19 (step S101). The detection of the ID card insertion is accomplished by a card detecting sensor which is composed of a photoelectric sensor or a micro switch. When the ID card is inserted, the signal from this sensor changes from OFF to ON (from low level to high level) and the edge appearing here (referred to as the "insertion edge" hereafter) is detected to show that an ID card has been inserted.

When the ID card insertion is detected ("Y" in step S101), the CPU 11 compares the section code read during the ID card insertion with the section codes previously stored in the NVRAM 16 to determine if there is a match, and if so, the CPU 11 sets the variable "CARD NO." to the read section code. If not, a number unassigned as a section code is set into the variable "CARD NO." and is stored in the SRAM 15 (step S102) It should be noted here that the section codes use the numbers from "01" to "99" in this embodiment, so that "0" is used as the number to be set when there is no match in NVRAM 16.

The CPU 11 judges whether the variable "CARD NO." is "0", and if not, which means that the section code of the ID card is stored in the NVRAM 16, the CPU sets the copy allowance transmission flag to "1", resets the copying prohibit flag to "0" and returns to the main routine (steps S103, S104 and S105). On the other hand, if the variable "CARD NO." is "0" in step S103, which means the section is not subjected to the management of the host computer 90, the CPU 11 does not allow copying operation and returns to the main routine.

Meanwhile, when the insertion edge is not detected back in step S101, the CPU 11 proceeds to step S106 to judge whether an ID card has already been inserted into the card reader 19. This is judged easily from the current status, that is, ON or OFF, of the detecting sensor.

When the ID card has already been inserted ("Y" in step S106), which means that the processes from steps S101 to S105 were performed after the detection of the insertion edge, the CPU 11 returns to the main routine. On the other hand, when an ID card is no longer inserted due to having been removed or the like ("N" in step S106), the copying operation should not be allowed. In this case, the CPU 11 judges the status of the copying prohibit flag. When the flag is set to "0", the CPU 11 sets the copying prohibit transmission flag to "1" and the copying prohibit flag to "1", and returns to the main routine (steps S107 to S109).

When the copying prohibit flag is set to "1" in step S107, the copying operation has already been prohibited. Therefore, the CPU 11 returns to the main routine.

After the ID card processing of step 13 back in FIG. 5, the transmission process of step S14 is performed.

Figure 7:
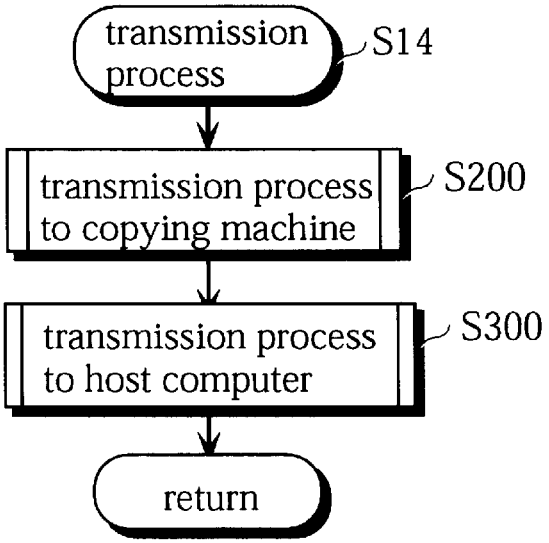
FIG. 7 is a flow chart of a subroutine of the transmission process (step S14) in FIG. 5.

In this transmission process shown in FIG. 7, the transmission processes to the copying machine 4 (step S200) and to the host computer 90 (step S300) are performed.

Figure 8:
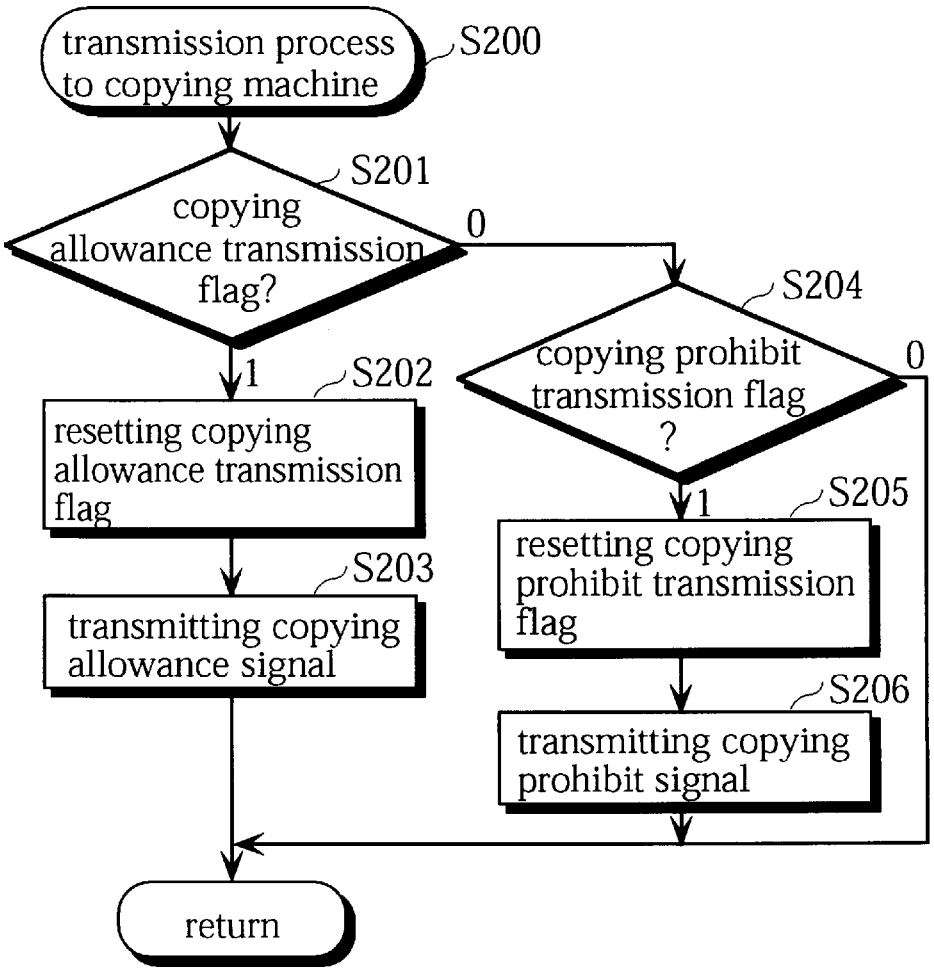
FIG. 8 is a flow chart of a subroutine of the transmission process to the copying machine (step S200) in FIG. 7.

FIG. 8 is a flow chart of the subroutine of the transmission process to the copying machine in step S200. The CPU 11 first checks the setting status of the copying allowance transmission flag (step S201). When the flag is set to "1", as explained in step S104 of FIG. 6, which means the section code of the ID card matches one of the section codes stored in the NVRAM 16, the CPU 11 resets the copying allowance transmission flag to "0" and transmits the copying allowance signal to the main control unit 400 (steps S202 and S203).

On the other hand, when the copying allowance transmission flag is set to "0" in step S201, the CPU 11 checks the setting status of the copying prohibit transmission flag (step S204). When the flag is set to "1", the CPU 11 resets the copying prohibit transmission flag to "0" and transmits the copying prohibit signal to the main control unit 400 (steps S205 and S206). When the copying prohibit transmission flag is set to "0" in step S204, the CPU 11 returns to the subroutine of the transmission process of FIG. 7.

By means of the ID card processing of step S13 and the transmission process to the copying machine 4 of step S200, the copying allowance signal is transmitted to the copying machine 4 only when an ID card is inserted into the card reader 19 and the section code of the ID card is judged to have been registered. Otherwise, the copying prohibit signal is transmitted to the copying machine 4.

Figure 9:
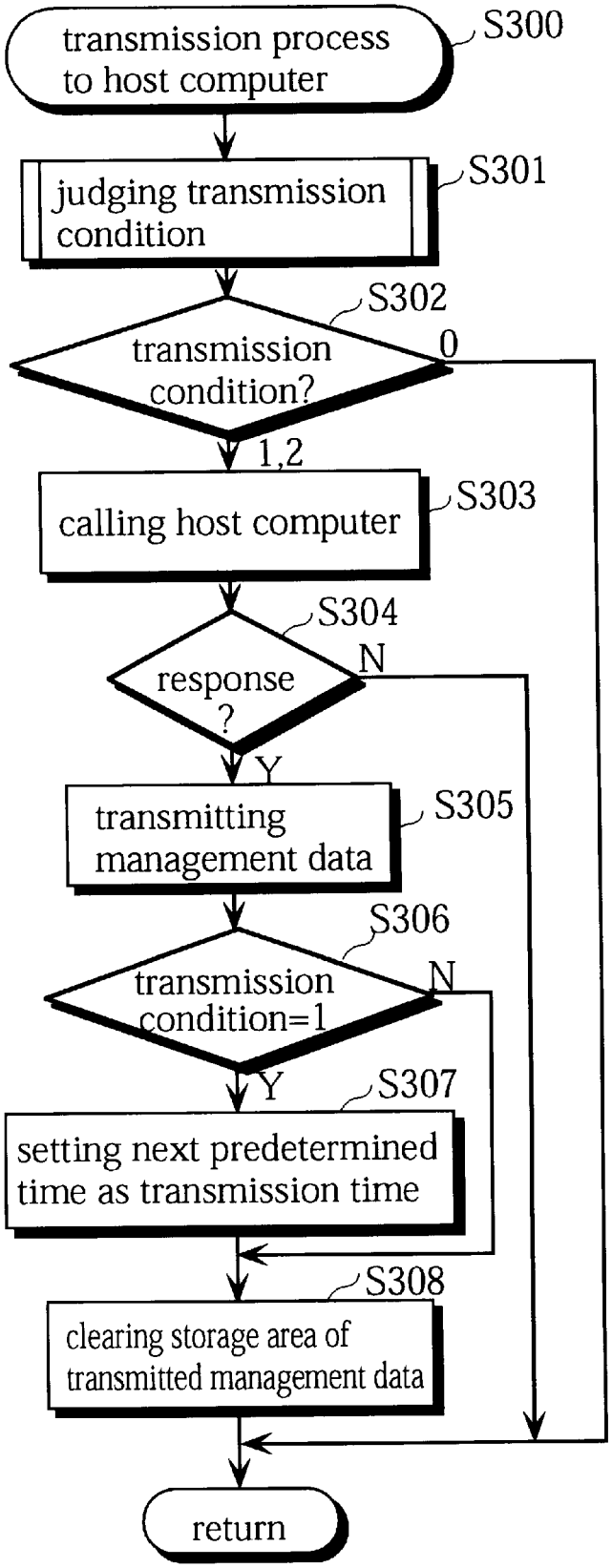
FIG. 9 is a flow chart of a subroutine of the transmission process to the host computer (step S300) in FIG. 7.

FIG. 9 is a flow chart of a subroutine of the transmission process to the host computer in step S300 of FIG. 7.

In step S301, the CPU 11 determines the transmission condition to show whether the management data stored in the registration table T should be transmitted to the host computer 90.

Figure 10:
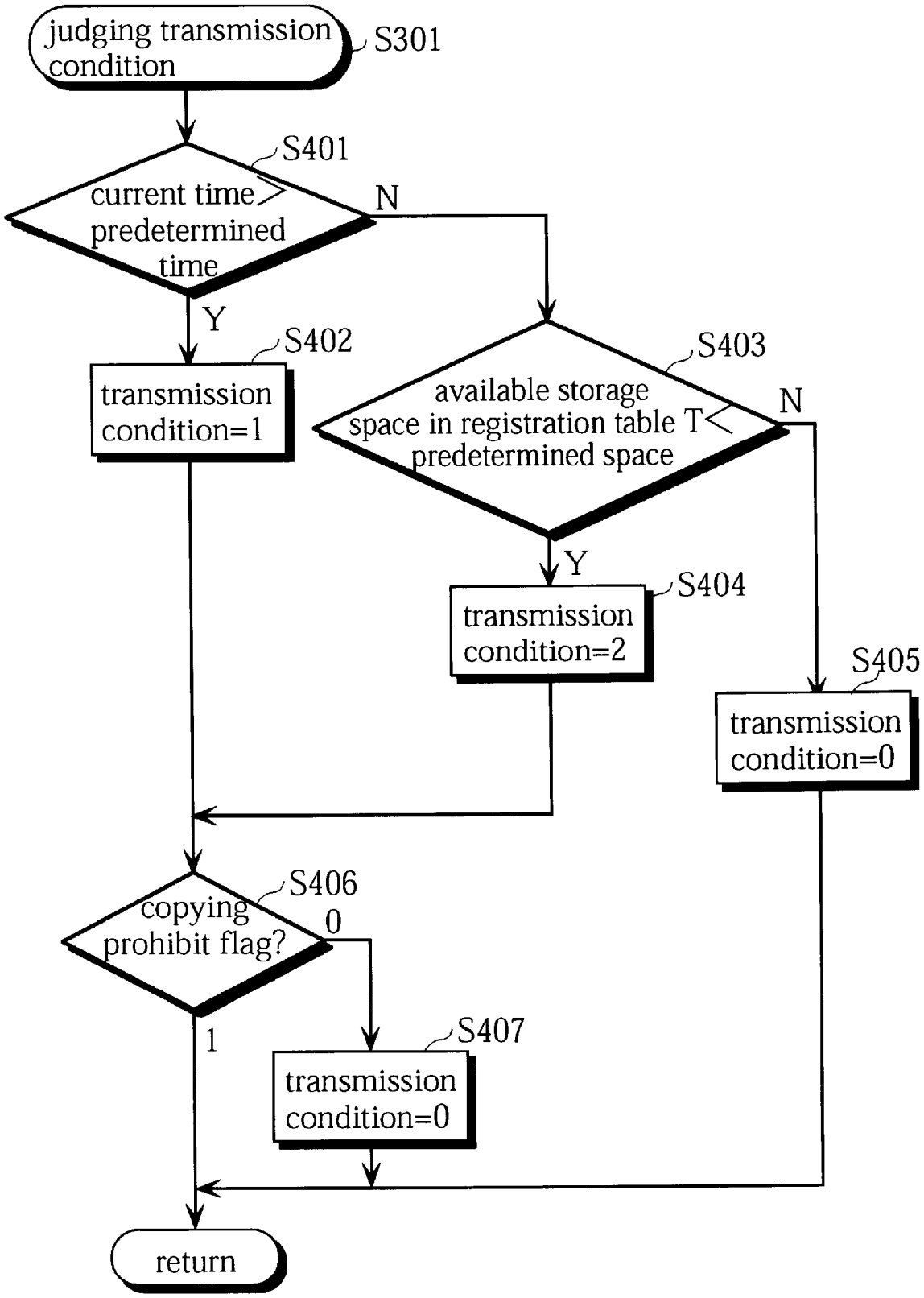
FIG. 10 is a flow chart of a subroutine of the determination of a transmission condition (step S301) in FIG. 9.

FIG. 10 is a flow chart of a subroutine of the determination of the transmission condition.

The CPU 11 first judges whether the current time has passed the predetermined time (step S401). When it has, the transmission condition is set to "1" (step S402). When it has not, the CPU 11 moves to step S403 and checks the amount of storage available in the registration table T. If the amount of available storage is below the specified limit, the transmission condition is set to "2" (step S404), but if the available storage is equal to or larger than the specified limit, the transmission condition is set to "0" and then the CPU 11 returns to the subroutine of FIG. 9 (step S405).

If the setting of the transmission condition is "1" or "2" in steps S402 and S404, it is desirable for the data to be transmitted after the updating of the management data is complete because the copying is being currently performed or appears likely. In this case, the CPU 11 checks the setting of the copying prohibit flag in step S406. When it is set to "1", copying operation is prohibited, so the CPU 11 returns to the subroutine of FIG. 9, leaving the transmission condition "1" or "2" as it is. When the copying prohibit flag is set to "0", a copying operation has been allowed so that the management data may be updated. Therefore, the CPU 11 resets the transmission condition to "0" (step S407) and returns to the subroutine of FIG. 9.

After the transmission condition is set in step S301 as described above, the CPU 11 checks the setting of the transmission condition (step S302) back in the flow chart of FIG. 9. When the transmission condition is set to "0", the management data is not to be transmitted so the CPU 11 returns to the subroutine of the transmission process in FIG. 7. On the other hand, when it is set to "1" or "2", the management data should be transmitted to the host computer 90, so that the CPU 11 reads the dial-up number of the host computer 90 from the NVRAM 16 and calls the host computer 90 (step S303).

When the host computer 90 responds to this call ("Y" in step S304), the apparatus ID stored in the NVRAM 16 and all of the management data stored in the registration table T of the SRAM 15 are transmitted through the communication lines (step S305). When the host computer 90 does not respond to the call, the CPU returns to the subroutine of transmission process in FIG. 7.

When the transmission condition is set to "1", that is, when the management data is transmitted after the predetermined time has been passed, the next predetermined time as the transmission time is set (steps S306 and S307). The CPU 11 then clears the storage area of the registration table T for the management data which has been transmitted to the host computer 90 (step S308). Accordingly, the management data for other sections can be stored.

When in step S306 the transmission condition is not set at "1", which is to say, when the transmission condition is set at "2" and the management data has been transmitted before the predetermined time has been reached due to the reduction in the amount of available storage, the next predetermined time does not need to be set. In this case, the CPU 11 clears the storage area for the transmitted management data in the registration table T without performing step S307, and returns to the subroutine of the transmission process in FIG. 7.

The CPU 11 returns to the main routine in FIG. 5 after performing the ID card processing of step S13 and the transmission process of step S14, and performs other processes, such as the registration process of the apparatus ID set through the settings of the DIP switches 21 to 24 into the NVRAM 16 and an instruction process to instruct the main control unit 400 to display the necessary message on the operation panel 40 showing that the section code of the inserted ID card does not match any of the stored section codes (step S15). After this, the CPU 11 waits for the internal timer to finish (step S16) and returns to step S12 to repeat the process described above.

Meanwhile, when step S17 is activated by the interruption of the serial interface 12, the CPU 11 receives the copying signal from the main control unit 400 and performs the reception process for the registration of the management data into the registration table T of the SRAM 15.

Figure 11:
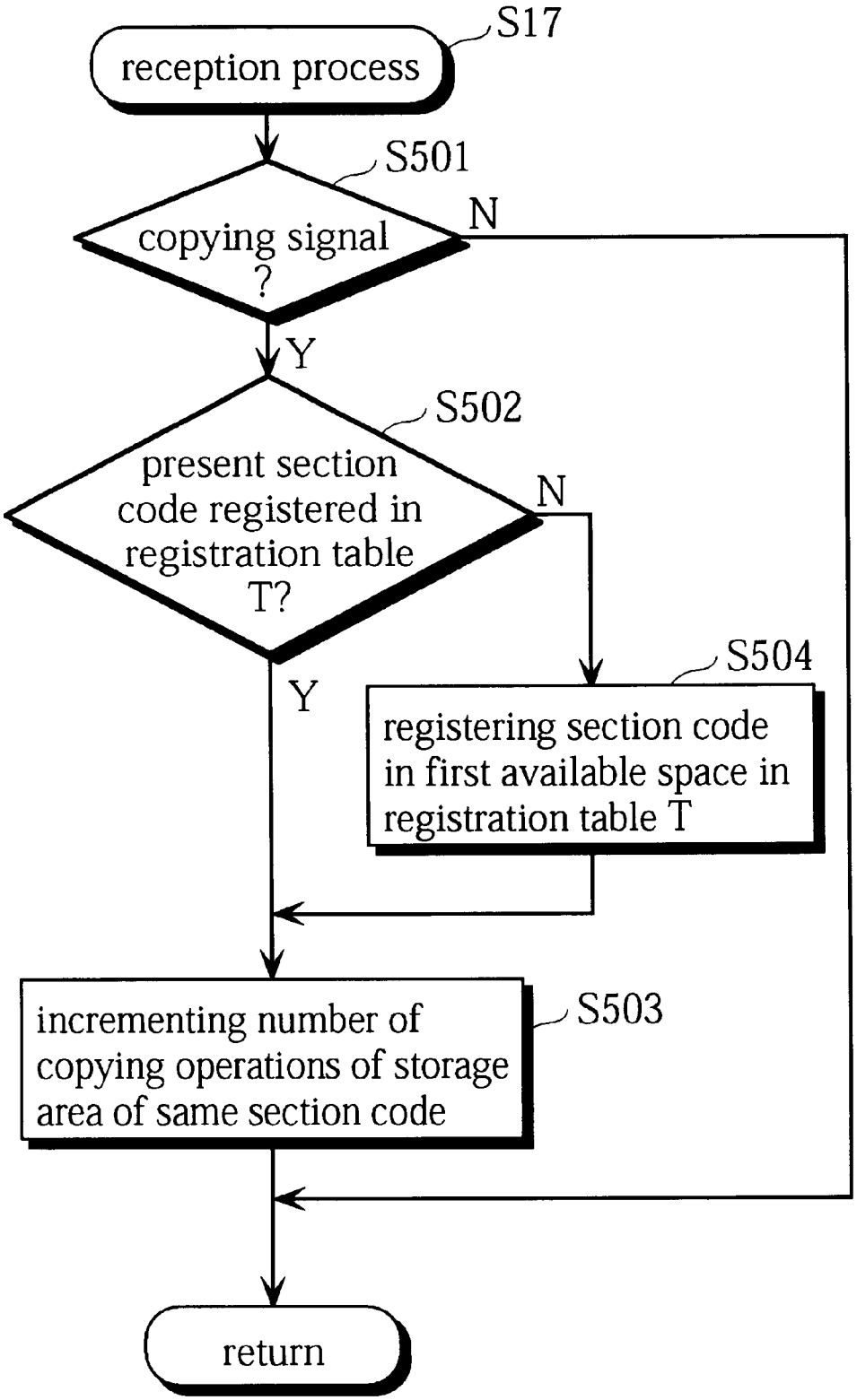
FIG. 11 is a flow chart of a subroutine of the reception process (step S17) in FIG. 5.

FIG. 11 is a flow chart of this reception process.

The received signal is first analyzed, and if it is a copying signal sent from the main control unit 400 every time a copying operation is performed, the CPU 11 then judges whether the section code of the section which is currently being allowed to make a copy, has been registered in the registration table T (steps S501 and S502). When it has, the CPU 11 increments the number of copying operations stored in the storage area corresponding to the section code by "1" and returns to the main routine of FIG. 5(step S503).

On the other hand, when the section code has not yet been registered in the registration table T, the section code is registered in the first available space in the registration table T and the number of copying operations is incremented in the corresponding storage area (steps S503 and S504), and the CPU returns to the main routine in FIG. 5.

(3-2) Management Operation by CPU 41 of Copying Machine 4

Figure 12:
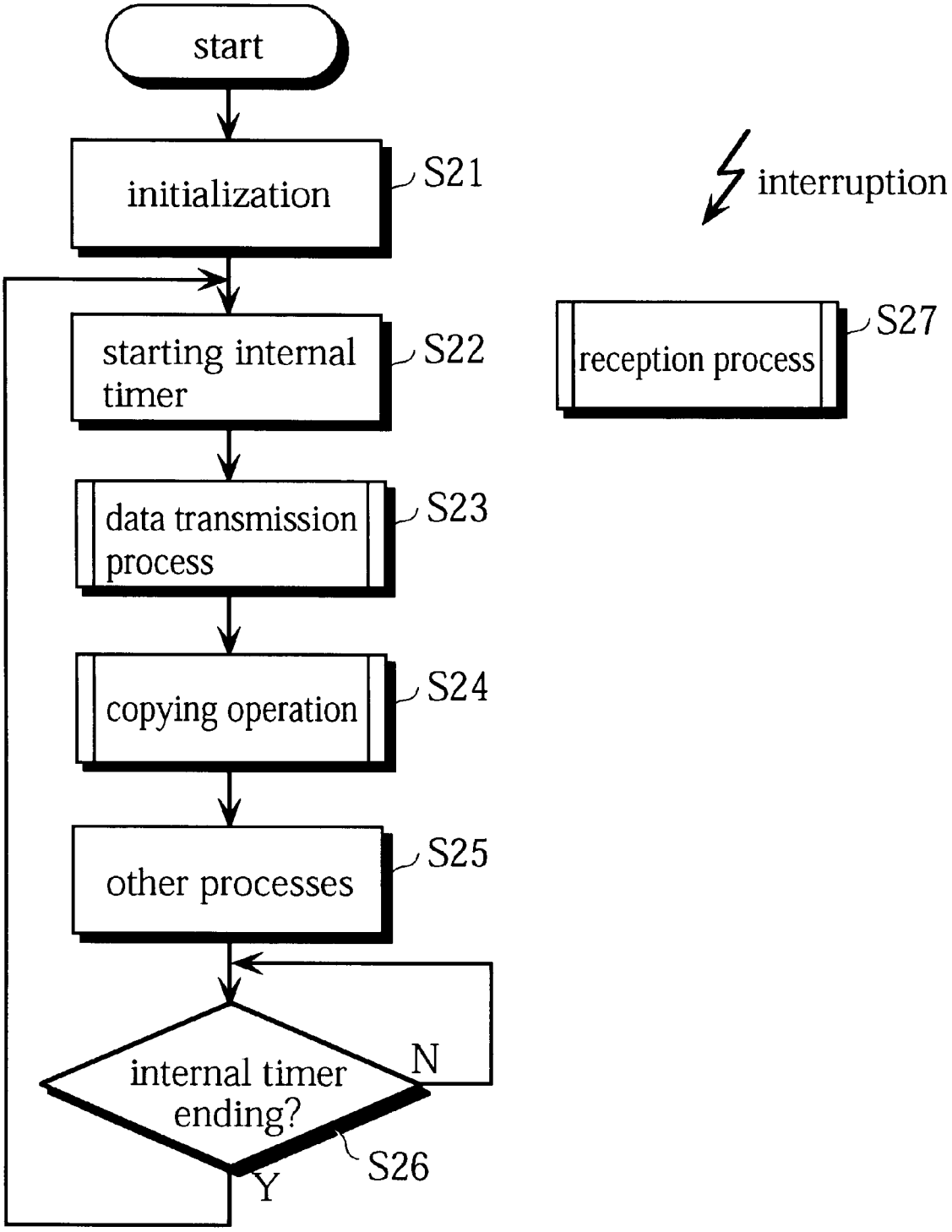
FIG. 12 is a flow chart of the main routine of the main control unit of the copying machine.

FIG. 12 is a flow chart of the main routine of the management operation performed by the CPU 41 in the main control unit 400.

When the copying machine 4 is turned on, the CPU 41 reads the initialization program stored in the ROM 45, initializes the units (step S21), and starts timing using the internal timer to perform the time management for the processing routines of the copying machine 4 (steps S22 and S26).

Figure 13:
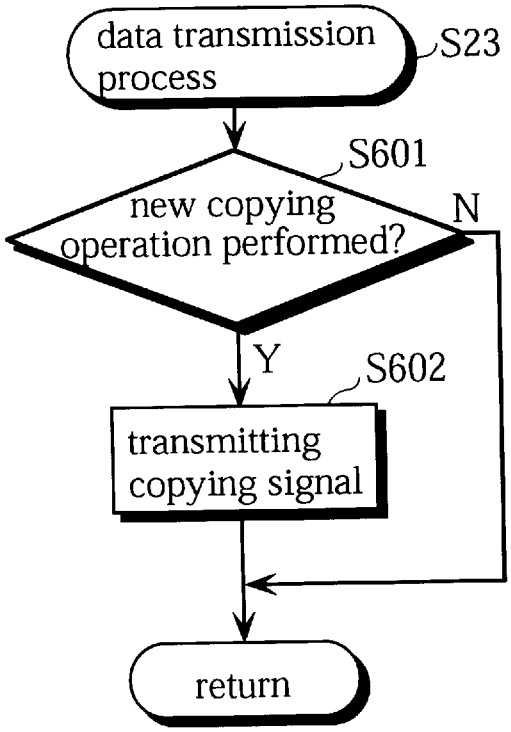
FIG. 13 is a flow chart of a subroutine of the data transmission process. (step S23) in FIG. 12.

After starting the internal timer, the data transmission process of step S23 is performed and the copying signal is transmitted to the management control unit 100. FIG. 13 is a flow chart of a subroutine of the data transmission process. The CPU 41 first judges whether a new copying operation has been performed (step S601). If a new copying operation is judged to have been performed, the CPU 41 generates a copying signal and transmits the signal to the management control unit 100 before returning to the main routine in FIG. 12 (step S602). When no new copying operation has been performed, the CPU returns to the main routine in FIG. 12.

The above judgement of the presence or absence of the new copying operation may be performed as follows. A photoelectric sensor or a micro switch may be set at the specified position of a feeding part of a paper cassette or of a discharge tray to detect the copying paper passing through, and the judgement can be made by the presence or absence of the detection signal. Alternatively, since the copying operation is generally controlled by the CPU 41 with a predetermined timing, the new copying operation may be judged to have been performed at the end of the timing of one copying operation.

After the data transmission process, the CPU 41 returns to step S24 of FIG. 12 and performs the copying operation.

Figure 14:
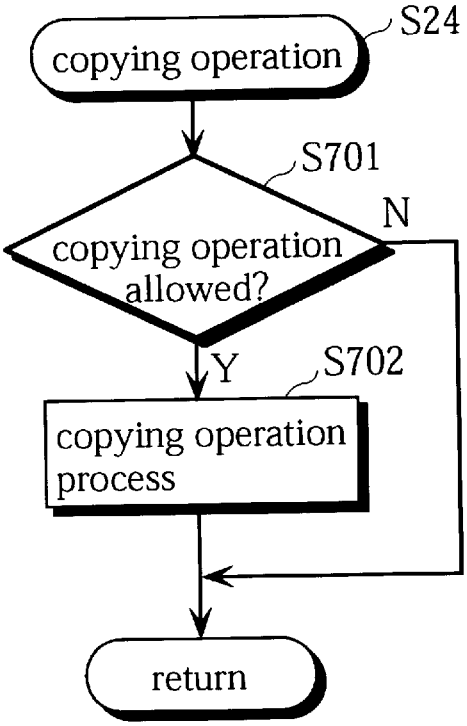
FIG. 14 is a flow chart of a subroutine of the copying operation (step S24) in FIG. 12.

FIG. 14 is a flow chart of the subroutine of the copying operation. The CPU 41 first judges whether the copying operation has been allowed (copying allowance) (step S701). This judgement, as described later, is achieved in accordance with the setting in the reception process of step S27 which is made after the copying allowance signal or the copying prohibit signal is received from the management control unit 100(see FIG. 12).

When the copying operation has been allowed in step S701, the CPU 41 receives the instructions from the user through the operation panel 40, performs the copying operation in the indicated copying mode (step S702) and returns to the main routine of FIG. 12. When the copying has not been allowed in step S701, the CPU 41 returns to the main routine in FIG. 12.

In step S25 back in FIG. 12, other processes, such as the control process for the display on the operation panel 40, are performed. After this the CPU 41 waits for the internal timer to end (step S26) and returns to step S22 to repeat the process described above.

Meanwhile, when step S27 is activated by an interruption received by the serial interface 43, the CPU 41 performs the reception process to determine whether to allow the copying operation in accordance with the management data transmitted from the management control unit 100.

Figure 15:
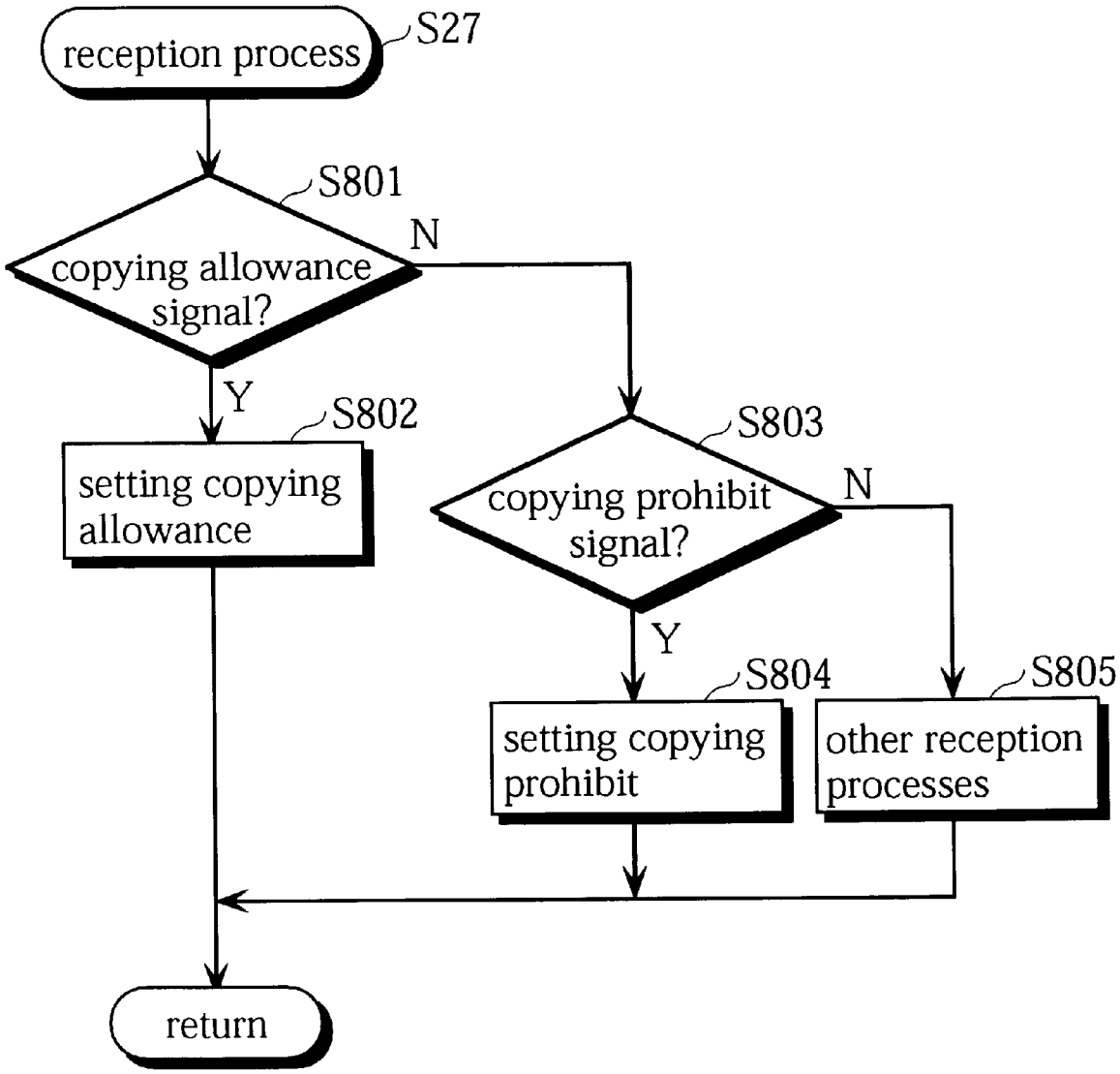
FIG. 15 is a flow chart of a subroutine of the data reception process (step S27) in FIG. 12.

FIG. 15 is a flow chart of the subroutine of the data reception process of step S27.

The received signal from the management control unit 100 is first analyzed, and if it is the copying allowance signal (see step S203 in FIG. 8), the copying allowance is set (steps S801 and S802). If it is not, it is judged whether the received signal is the copying prohibit signal. If it is, the copying prohibition is set (steps S803 and S804). When the received signal is neither the copying allowance signal nor the copying prohibit signal ("N" in steps S801 and S803), other reception processes corresponding to the content of the signal are performed (step S805). As one example, on the reception of the information from the management control unit 100 that an ID card has not been inserted into the card reader 19, the CPU 41 instructs the display unit of the operation panel 40 to display an "Insert ID card" message. After this, the CPU 41 returns to the main routine.

(3-3) Control Operation in Host Computer 90

The host computer 90 receives the data (the management data and the apparatus ID data) from the management control unit 100 of the management apparatus 1 and accumulates the number of copying operations for each section in accordance with the received data.

Figure 16:
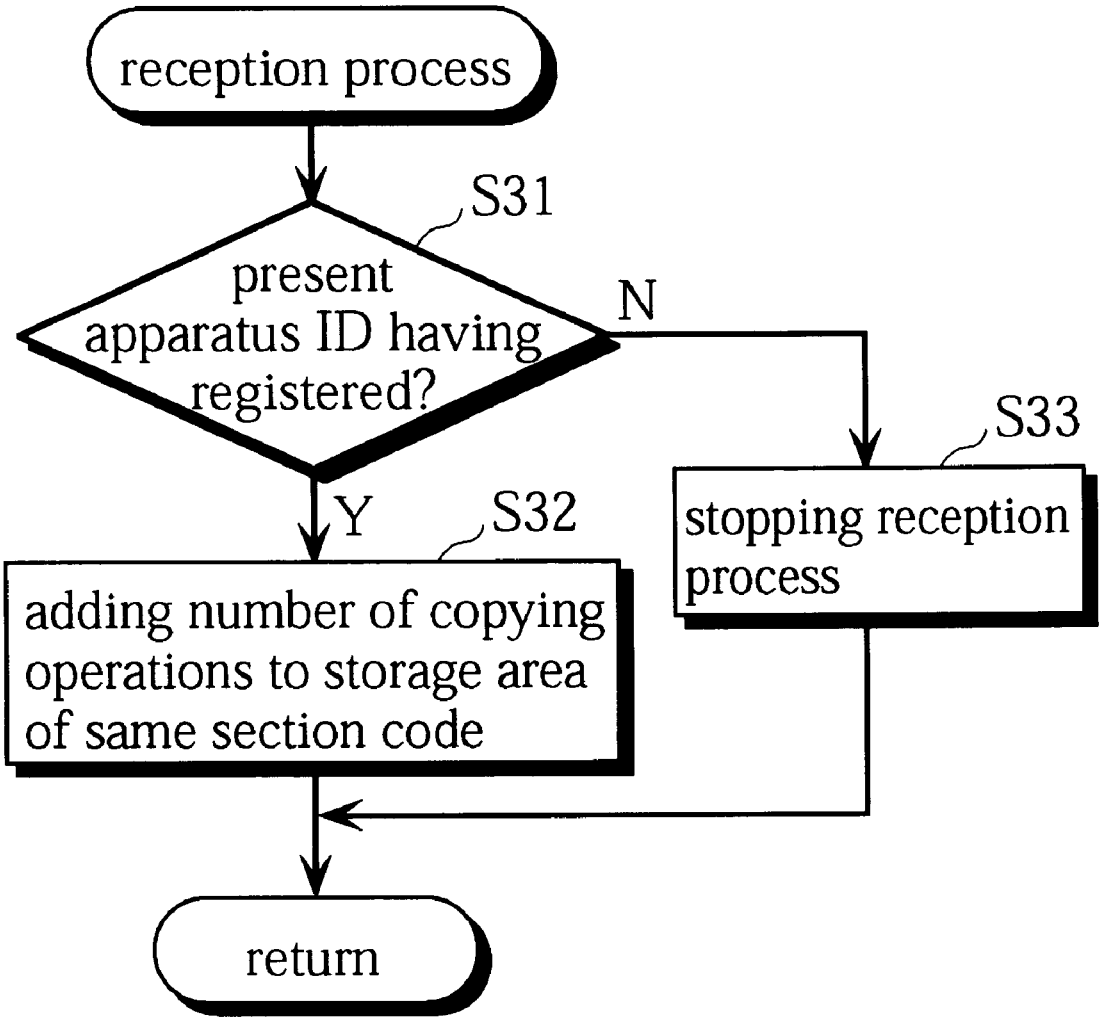
FIG. 16 is a flow chart of a subroutine of the data reception process of the host computer.

FIG. 16 is a flow chart of the subroutine of the data reception process of a series of process routines in the host computer 90.

After analyzing the content of the data received from the management control unit 100, the CPU 91 (see FIG. 3) in the host computer 90 compares the apparatus ID included in the received data with the managed apparatus IDs stored in the RAM 97 to determine if there is a match. If negative, the CPU 91 judges that the data of a copying machine which is not subjected to the management of the host computer 90 has been transmitted by mistake. The CPU 91 stops the reception process here (steps S31 and S33).

On the other hand, if the apparatus ID matches one of the managed apparatus IDs, the CPU 91 judges that the management data has been transmitted from one of the managed copying machines 4, and updates the data in the accumulating table in accordance with this transmitted management data. Here, as the management data includes the section code and the number of copying operations described above, the CPU 91 adds the number of copying operations included in the management data to the number of copying operations stored in the storage area corresponding to the section code in the accumulating table in the RAM 97, and stores the updated number (step S32). Accordingly, the number of copying operations performed by the copying machine 4 is accumulated for each section.

The service center has the CPU 91 calculate the total amount billed for each section regularly, for example, at the end of each month, in accordance with the stored number on the accumulating table. The calculated bills are then outputted for each section by the printer 94 and are sent to each section. Programs for calculating the copying fee and for generating the bills are well known, and will therefore not be described.

An image forming apparatus management system related to the present invention has been described above focusing on a management system for the number of copying operations performed by a copying machine, although it should be obvious that the present invention is not limited to the present embodiment.

In the present embodiment, the management apparatus 1 is provided with a card reader 19 by which the information of the ID card is read and the section code is inputted. Alternatively, however, the user may directly input the section code, for example, by using the 10-key on the operation panel 40.

The registration table T only includes the section code and the number of copying operations as the management data in the present embodiment, although the content of the management data may be increased. For instance, the management data may include information for the copying paper size, information for the execution or non-execution of two-sided copying, and the number of the copying paper sheets used from each paper cassette. When using a copying machine which performs both monochrome copying and full-color copying, information as to which function is selected may also be registered as the management data. By adding different types of management data as necessary, the appropriate maintenance and the generation of detailed bills are possible. It hardly need be said that the effect of the savings in memory for managing the number of copying operations in each copying machine in the present invention compared to the related art is more noticeable as the extent of the management data to be accumulated for each section increases.

The CPU sets the transmission condition in accordance with the amount of the available storage in the registration table T in step S403 of FIG. 10. However, the CPU 11 may judges whether the number of section codes stored in the registration table T has reached a predetermined number, and when it has, the transmission condition is set to "2", and when it has not, the transmission condition is set to "0".

While the description of step S305 of FIG. 9 states that all of the management data stored in the registration table T is transmitted to the host computer 90, it is also possible for only part of such management data to be transmitted. In such case, only the management data that has been transmitted is cleared from the registration table in step S308.

In the present embodiment, the management data of a plurality of copying machines 4 are transmitted to the host computer 90 using the single external public telephone line through the PBX, although each copying machine 4 may transmit the data to the host computer via a separate public telephone line.

In the present embodiment, a management system for the number of copying operations performed by the copying machine is described, although it should be noted here that the present invention can be applied to the management for the number of image formations in an image forming apparatus such as a printer or a facsimile machine.

Although the present invention has been fully described by way of examples with reference to the accompanying drawings, it is to be noted that various changes and modifications depart will be apparent to those skilled in the art. Therefore, unless otherwise such changes and modifications depart from the scope of the present invention, they should be constructed as being included therein.

What is claimed is:

1. An image forming apparatus management system composed of an image forming apparatus and a central accumulating apparatus which is connected to the image forming apparatus by a communication line, the image forming apparatus comprising:

an identification code reception unit for receiving at least one identification code that identifies a user;

a counting unit for counting a number of image formations for each identification code;

a first storage unit for storing each identification code received by the identification code reception unit associated with the number of image formations counted by the counting unit;

a transmission unit for transmitting at least part of the identification codes and associated numbers of image formations stored in the first storage unit to the central accumulating apparatus via the communication line when a number of identification codes in the first storage unit reaches a predetermined number; and a storage clearing unit for clearing the first storage unit of the identification codes and associated numbers of image formations that have been transmitted by the transmission unit, and the central accumulating apparatus comprising:

a reception unit for receiving the identification codes and associated numbers of image formations transmitted from the image forming apparatus; and an accumulating unit for accumulating and storing data of the number of image formations for each user, in accordance with the identification codes and associated numbers of image formations received by the reception unit.

2. The image forming apparatus management system of claim 1, wherein the accumulating unit comprises:

a second storage unit for storing numbers of image formations associated with identification codes; and a storage updating unit for adding a received number of image formations associated to a received identification code to a number of image formations associated to a matching identification code in the second storage unit and for updating a content of the second storage unit.

3. The image forming apparatus management system of claim 2, wherein a number of identification codes that can be stored in the first storage unit is less than a number of identification codes that can be stored in the second storage unit.

4. The image forming apparatus management system of claim 1, wherein the image forming apparatus is a copying machine.

5. The image forming apparatus management system of claim 1, wherein the image forming apparatus is a printer.

6. The image forming apparatus management system of claim 1, wherein the image forming apparatus is a facsimile machine.

7. The image forming apparatus management system of claim 1, wherein the identification code reception unit includes a card reader for reading information from a card on which the identification code is recorded.

8. The image forming apparatus management system of claim 1, wherein the image forming apparatus further comprises an image forming prohibit unit for prohibiting an image forming operation when the identification code reception unit has not received an identification code.

9. The image forming apparatus management system of claim 8, wherein the image forming apparatus is further comprises an image forming allowance unit for allowing an image forming operation when the identification code received by the identification code reception unit matches an identification code that has been registered beforehand.

10. The image forming apparatus management system of claim 1, wherein when the identification code received by the identification code reception unit is already present in the first storage unit, the first storage unit updates the number of image formations associated to the identification code.

11. The image forming apparatus management system of claim 1, wherein each user is a section in an organization.

12. An image forming apparatus whose number of image formations is managed by a central accumulating apparatus which is connected to the image forming apparatus via a communication line, the image forming apparatus comprising:

an identification code reception unit for receiving at least one identification code that identifies a user;

a counting unit for counting a number of image formations for each identification code;

a storage unit for storing each identification code received by the identification code reception unit associated with a number of image formations counted by the counting unit;

a transmission unit for transmitting at least part of the identification codes and associated numbers of image formations stored in the storage unit to the central accumulating apparatus Via the communication line when a number of identification codes in the storage unit reaches a predetermined number; and a storage clearing unit for clearing the storage unit of the identification codes and associated numbers of image formations that have been transmitted by the transmission unit.

13. The image forming apparatus management system of claim 12, wherein the image forming apparatus is a copying machine.

14. The image forming apparatus management system of claim 12, wherein the image forming apparatus is a printer.

15. The image forming apparatus management system of claim 12, wherein the image forming apparatus is a facsimile machine.

16. The image forming apparatus management system of claim 12, wherein the identification code reception unit includes a card reader for reading information of a card on which an identification code is recorded, and receives the identification code.

17. The image forming apparatus management system of claim 12, wherein the image forming apparatus further comprises an image forming prohibit unit for prohibiting an image forming operation when the identification code reception unit has not received an identification code.

18. The image forming apparatus management system of claim 17, wherein the image forming apparatus is further comprises an image forming allowance unit for allowing an image forming operation when the identification code received by the identification code reception unit matches an identification code that has been registered beforehand.

19. The image forming apparatus management system of claim 12, wherein when the identification code received by the identification code reception unit is already present in the storage unit, the storage unit updates the number of image formations associated to the identification code.

20. The image forming apparatus management system of claim 12, wherein each user is a section in an organization.

21. A management method for a number of image formations in an image forming apparatus management system composed of a central accumulating apparatus and an image forming apparatus, wherein the management method includes a first set of steps performed by the image forming apparatus and a second set of steps performed by the central accumulating apparatus, wherein the first set of steps includes:

(1) receiving at least one identification code for identifying a user and of counting the number of image formations performed in relation to the received identification code;

(2) storing the received identification code associated with the number of image formations performed in relation to each identification code into a first storage unit;

(3) transmitting at least part of the identification codes and associated numbers of image formations stored in the first storage unit through lines when a number of identification codes stored in the first storage unit reaches a predetermined number; and (4) clearing the transmitted identification codes and associated numbers of image formations from the first storage unit, and wherein the second set of steps includes:

(1) receiving the identification codes and associated number of image formations which are transmitted from the image forming apparatus; and (2) accumulating and storing data of the number of image formations for each user in accordance with the identification codes and associated number of image formations received by the reception unit.

22. A management method for a number of image formations performed by an image forming apparatus which is connected to a central accumulating apparatus through lines, wherein the management method includes:

(1) receiving at least one identification code for identifying a user and of counting the number of image formations performed in relation to the received identification code;

(2) storing the received identification code associated with the number of image formations performed in relation to each identification code into a storage unit;

(3) transmitting at least part of the identification codes and associated numbers of image formations stored in the storage unit through lines when a number of identification codes stored in the storage unit reaches a predetermined number; and (4) clearing the transmitted identification codes and associated numbers of image formations from the storage unit.

23. An image forming apparatus comprising:

a reception unit for receiving at least one identification code that identifies a user;

a counter for counting a number of image formations;

a memory for storing the number of image formations corresponding to the identification code;

a transmission unit for externally transmitting data stored in the memory when an empty area of the memory decreases below a predetermined amount of area; and a clearing unit for clearing the data that have been transmitted by the transmission unit.

24. The image forming apparatus of claim 23, wherein the memory stores the identification code and the number of image formations associated with the identification code.

25. The image forming apparatus of claim 24, further comprising a storage unit for updating the number of image formations associated with the identification code when the identification code received by the reception unit is already present in the memory, and for storing an identification code and a number of image formations associated with the identification code when the identification code received by the reception unit is not present in the memory.

26. An image forming apparatus comprising:

a reception unit for receiving at least one identification code that identifies a user;

a counter for counting a number of image formations;

a memory for storing the identification code and the number of image formations associated with the identification code;

a transmission unit for externally transmitting the identification codes and associated numbers of image formations stored in the memory when a number of identification codes stored in the memory reaches a predetermined number; and a clearing unit for clearing the identification codes and the associated numbers of image formations that have been transmitted by the transmission unit.

27. The image forming apparatus of claim 26, further comprising a storage unit for updating the number of image formations associated with the identification code when the identification code received by the reception unit is already present in the memory, and for storing an identification code and a number of image formations associated to the identification code when the identification code received by the reception unit is not present in the memory.

* * * * *